US006530313B1

(12) United States Patent
Sugawara et al.

(10) Patent No.: US 6,530,313 B1
(45) Date of Patent: Mar. 11, 2003

(54) SLIDE LOCKING MECHANISM

(75) Inventors: Masayoshi Sugawara, Sagamihara (JP); Hideaki Bando, Sagamihara (JP)

(73) Assignee: Aida Engeneering Co., Ltd., Kanagawa (JP)

( * ) Notice: Subject to any disclaimer, the term of this patent is extended or adjusted under 35 U.S.C. 154(b) by 281 days.

(21) Appl. No.: 09/666,639

(22) Filed: Sep. 21, 2000

(30) Foreign Application Priority Data

Oct. 29, 1999 (JP) ..... 11-307929

(51) Int. Cl.[7] ..... B30B 15/00

(52) U.S. Cl. ..... 100/53; 29/401.1; 29/893.1; 100/350; 425/153; 72/444

(58) Field of Search ..... 29/401.1, 893.1; 100/341, 350, 53; 72/444, 449; 425/153

(56) References Cited

U.S. PATENT DOCUMENTS

| | | | | |
|---|---|---|---|---|
| 2,185,551 A | * | 1/1940 | Glasner et al. | 100/350 |
| 3,855,920 A | | 12/1974 | Wright | |
| 3,855,921 A | | 12/1974 | Wright | |
| 3,999,477 A | * | 12/1976 | Good et al. | 100/350 |
| 4,232,773 A | * | 11/1980 | Cipriani | 100/53 X |
| 4,822,266 A | * | 4/1989 | Amano et al. | 100/53 X |
| 5,357,780 A | | 10/1994 | Brandnstetter | |
| 5,513,561 A | | 5/1996 | Biliskov | |

FOREIGN PATENT DOCUMENTS

| | | |
|---|---|---|
| DE | 3342948 | 11/1983 |
| EP | 0839640 | 5/1998 |

* cited by examiner

*Primary Examiner*—W. Donald Bray
(74) *Attorney, Agent, or Firm*—Darby & Darby

(57) ABSTRACT

A threaded member projecting from a press slide includes a projection on its upper end. A motor raises and lowers the threaded member in tandem with a slide adjustment mechanism. A plate disposed on a lower surface of a press crown is moved to slidably enclose the projection. The press slide is locked when the lower surface of the projection and the upper surface of the plate abut each other.

11 Claims, 7 Drawing Sheets

SLIDE LOCKING MECHANISM

BACKGROUND OF THE INVENTION

During maintenance or adjustment on a die press, the space between upper and lower dies is usually maximized. The slide attached to the upper die serves as a top-dead-center reference point. Maintenance or adjustments may require part or all of a tool, or the user's body, to come between the upper and lower dies. Accidental looseness in the die brake mechanism causes a safety hazard to exist. A slide lock mechanism prevents this type of accident.

For example, published Japanese patent number 10-29100 discloses a conventional slide locking device including a plurality of threaded shafts disposed on either side of the slide. Means for pivoting moves the threaded shafts up and down, and means for locking locks and unlocks the slide. Accommodating changes in the top-dead-center position caused by different die heights is difficult. Changing the die height changes the top-dead-center position by the same amount. Locking the slide at a new top-dead-center position requires adjusting the threaded shafts by the same amount as the top-dead-center position change.

In the conventional slide locking device, there is no linkage between the slide adjusting mechanism and the threaded shafts. Thus, if die height is changed, the threaded shafts must be manually and visually raised or lowered. This makes the operation complex and can lead to problems that include forgetting to lock the slide.

OBJECTS AND SUMMARY OF THE INVENTION

An object of the invention is to provide a slide locking mechanism that allows a slide to be locked without complex operations.

It is a further object of the invention to provide a slide locking mechanism with a direct drive control that allows a slide locking mechanism to be locked despite previous adjustments in die height.

It is a further object of the invention to provide a slide locking mechanism with an electronic drive control that allows the slide locking mechanism to be locked despite previous adjustments in die height.

It is a further object of the invention to provide a slide locking mechanism with an electronic drive control that allows the slide locking mechanism to locked at any slide position without manual adjustment.

Briefly stated, the present invention provides a slide locking device containing a threaded member projected from a press slide. A projection is disposed on the upper end of the threaded member. Means for raising and lowering the threaded member raises and lowers the threaded member in tandem with a slide adjustment mechanism. Disposed on a lower surface of a press crown is a plate, means for moving the plate, and blocks slidably supporting the plate. The press slide is locked when the lower surface of the projection and the upper surface of the plate abut each other.

According to an embodiment of the invention, there is provided a slide locking device comprising: a threaded member projected from the slide, means for raising and lowering the threaded member in tandem with die height adjustments, means for locking the threaded remember at a locked position, the locking means including a plate formed with a cut-out through which the threaded member loosely fits, means for moving the plate to a locked position, and a projection formed at an upper end of the threaded member so that the lower surface thereof abuts an upper surface of the plate in a locked position.

According to another embodiment of the invention, there is provided a means for raising and lowering a threaded member comprising: means for preventing the threaded members rotation, a worm wheel including a threaded section in an inner perimeter section thereof, the threaded section meshing with a threaded section of the threaded member, a worm shaft meshing with an outer perimeter of the worm wheel, means for transferring drive force from the slide adjusting mechanism to the worm shaft, and the means for transferring connected to a slide adjusting mechanism.

According to another embodiment of the invention, there is provided a means for raising and lowering a threaded member comprising: means for preventing the threaded member from rotating, a worm shaft meshing with an outer perimeter of a worm wheel, a motor driving the worm shaft, means for electronically measuring the die height, means for electronically detecting the position of the threaded member, means for measuring a position of the threaded member, and a control device for raising and lowering the threaded member based on a value measured by the die height measuring means.

The above, and other objects, feature and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
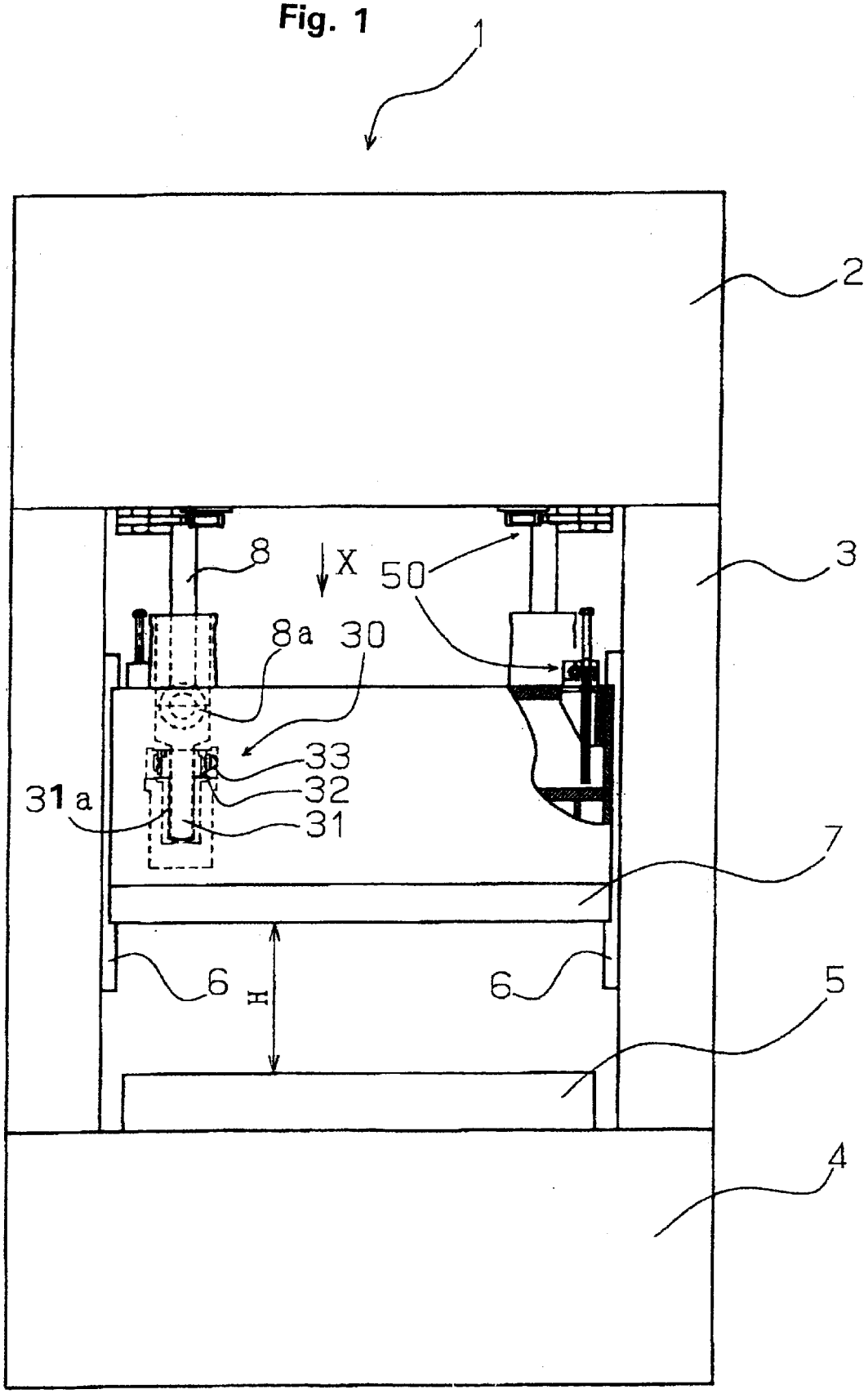
FIG. 1 is a front-view showing a press with the present invention attached.
Figure 2:
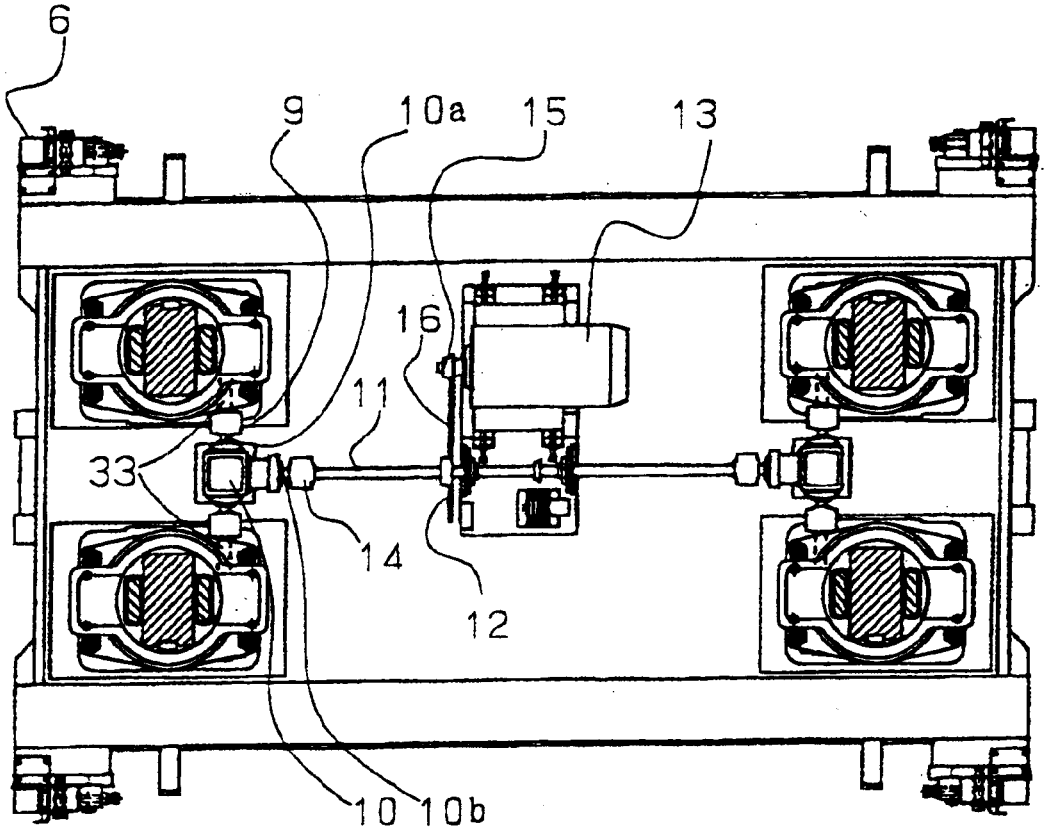
FIG. 2 is a top-view showing the inside of the slide as seen from arrow X in FIG. 1.

Referring to FIGS. 1 and 2, a press 1 includes a crown 2, columns 3, and a bed 4 secured to each other by tie rods not shown in the figures. A bolster 5 is disposed on bed 4. A slide 7 is disposed facing bolster 5 in a vertical direction. Slide 7 is supported by slide guides 6 disposed on columns 3 to allow vertical motion. FIG. 1 shows slide 7 at a top-dead-center position.

A slide driving mechanism, not shown, is disposed inside crown 2. Slide 7 is linked to the slide driving mechanism via multiple connecting rods 8. Slide adjusting mechanisms 30 are disposed at the bottom of connecting rods 8 and multiple connecting sections 8*a* that connect with slide 7. In this embodiment, four connecting sections 8*a* and slide-adjusting mechanisms 30 are disposed, with two of each on the left and two of each on the right in FIGS. 1 and 2.

A screw 31 and a worm wheel 32, having an inner perimeter meshing with a threaded portion 31 a of screw 31, are disposed in slide adjusting mechanism 30. The outer perimeter of worm wheel 32 meshes with a worm screw 33. Worm screw 33 is connected to an output shaft 10*a* of a gear box 10 via a coupling 9. An input shaft 10*b* of gear box 10 is connected to a shaft 11 via a coupling 14. A large pulley 12 is secured to shaft 11. A belt 1 is extended between large pulley 12 and a small pulley 15, disposed on a drive shaft of a motor 13 that drives slide adjusting mechanism 30.

To adjust a die height H, motor 13 is activated and shaft 11 is rotated by belt 16 creating a drive force. The drive force is transferred to input shaft 10*b* of gear box 10 via a coupling 14. The transferred drive force is output from output shaft 10*a* to rotate worm screw 33 and worm wheel 32. Thus, shaft 11 transfers drive force to input shafts 10*a* of gear boxes 10, and the drive force is output through the four output shafts 10*a,* causing the worm screws 33 to rotate in sync. Since worm screws 33 are rotated in sync, slide 7 can be raised or lowered by a small amount to adjust die height H.

A slide locking device 50 is disposed on the left and right of the lower surface of crown 2 and the side surface of slide 7.

Figure 3:
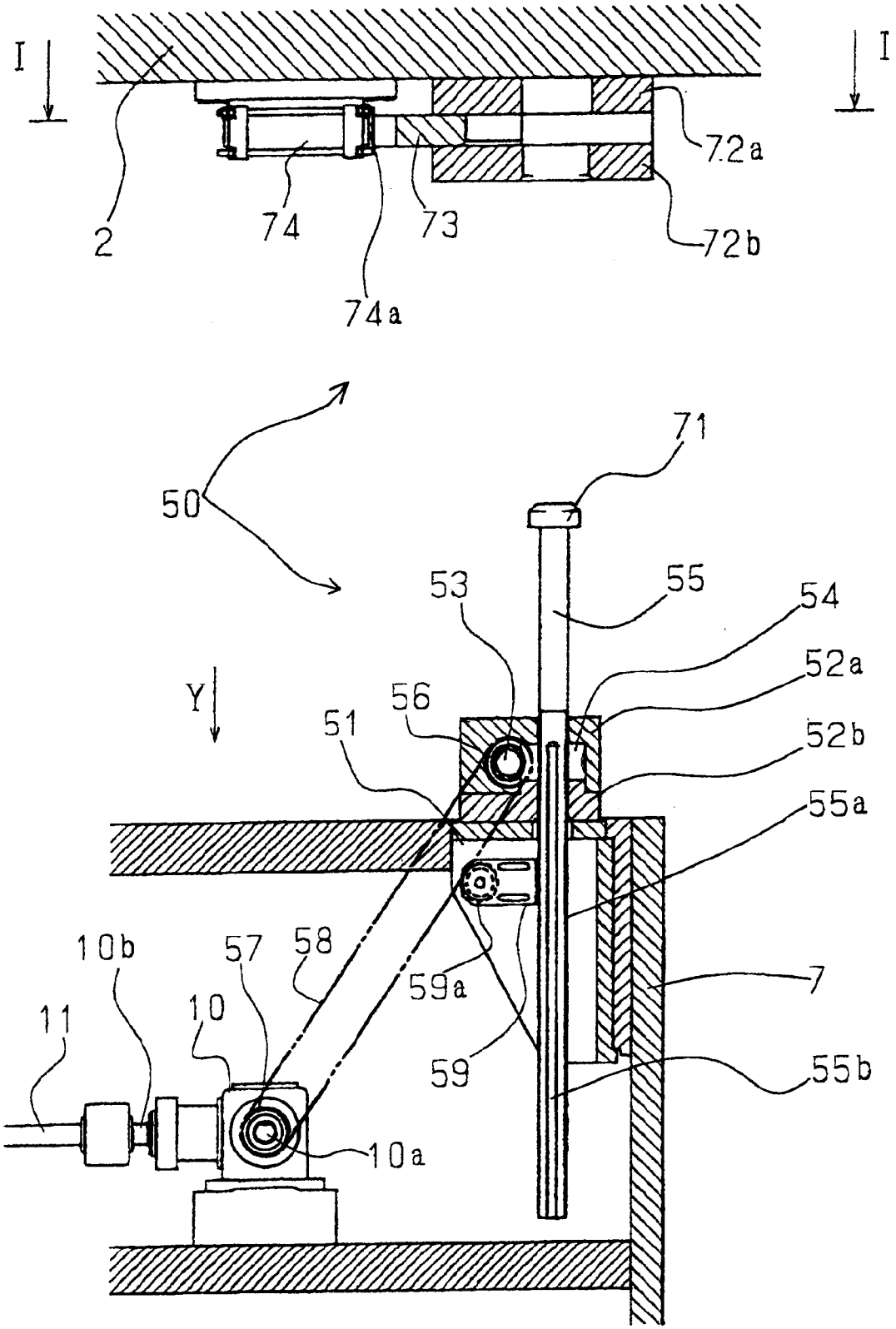
FIG. 3 is a detailed view showing the main elements of the present invention.

Referring to FIG. 3, slide 7,is shown at a bottom-dead-center position. A bracket 51 is disposed on an inner side surface of slide 7. Blocks 52*a,* 52*b* are disposed on the upper surface of bracket 51. A worm shaft 53 and a worm wheel 54 are disposed on block 52*a,* and worm shaft 53 meshes with the outer perimeter of worm wheel 54. A threaded member 55 is projected so that it passes vertically through bracket 51 and blocks 52*a,* 52*b.* A thread 55*a* of threaded member 55 meshes with the inner perimeter of worm wheel 54. A means for prevention rotation of threaded member 55, is formed from a key groove 55*b,* disposed on threaded member 55, and a key (not shown in the figure) fixed to block 52.

Blocks 72*a,* 72*b* are fixed to the lower surface of crown 2. A plate 73 is slidably disposed between blocks 72*a,* 72*b* so that it can be slid left or right. A cylinder 74 is disposed on the lower surface of crown 2 to serve as means for moving plate 73. A rod 74*a* of cylinder 74 is connected to plate 73. Openings larger than a diameter of a projection 71 are disposed on blocks 72*a,* 72*b.* A cut-out 73*a,* larger than the diameter of threaded member 55 and smaller than the diameter of protection 71 is disposed on plate 73.

Figure 4:
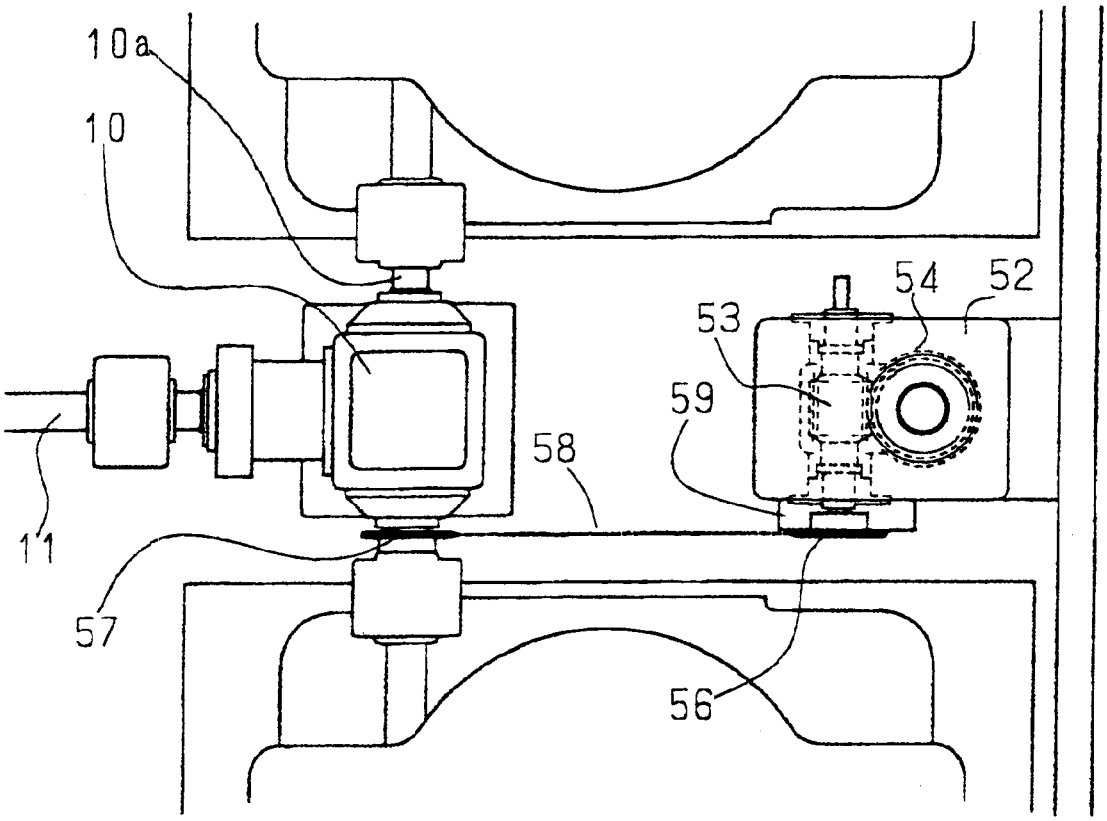
FIG. 4 is a top-view showing the inside of the slide as seen from arrow Y in FIG. 3.

Additionally referring to FIG. 4, sprockets 56, 57 are respectively disposed on worm shaft 53 and output shaft 10*a* of gear box 10 described above. A chain 58 extends between sprockets 56, 57. A tension adjusting device 59 is disposed on bracket 51 to adjust the tension of chain 58. Tension adjusting device 59 is movable to the left or to the right in FIG. 3. A sprocket 59*a* is disposed on tension adjusting device 59. Sprocket 59*a* meshes with chain 58. Thus, by moving tension adjusting device 59 left or right, the tension of chain 58 is adjusted.

Figure 5A:
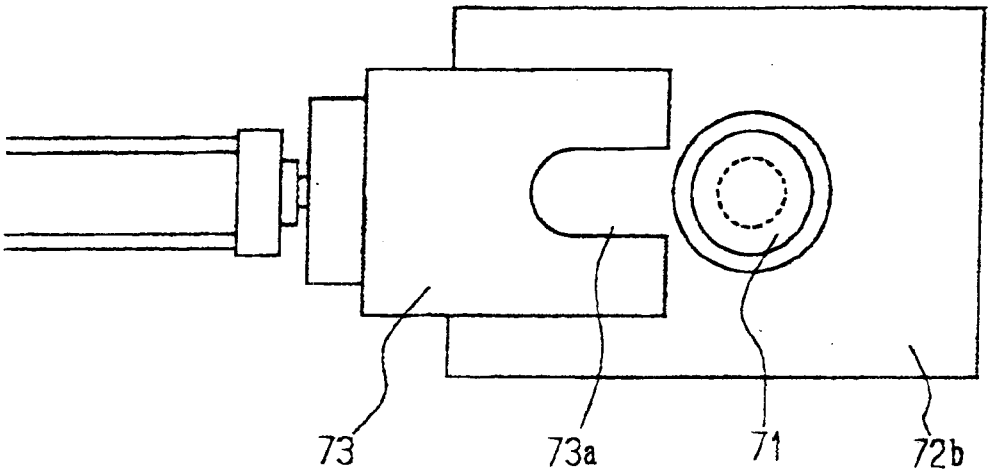
FIG. 5A is a cross-section drawing along) the line I—I on FIG. 3, showing an unlocked position.
Figure 5B:
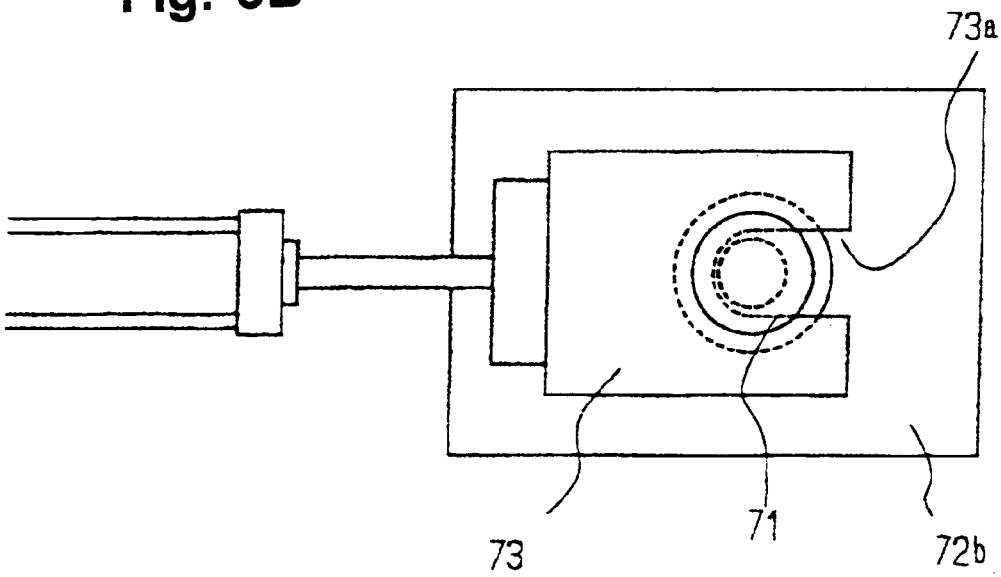
FIG. 5B is across-section drawing along the line I—I on FIG. 3, showing a locked position B.
Figure 6:
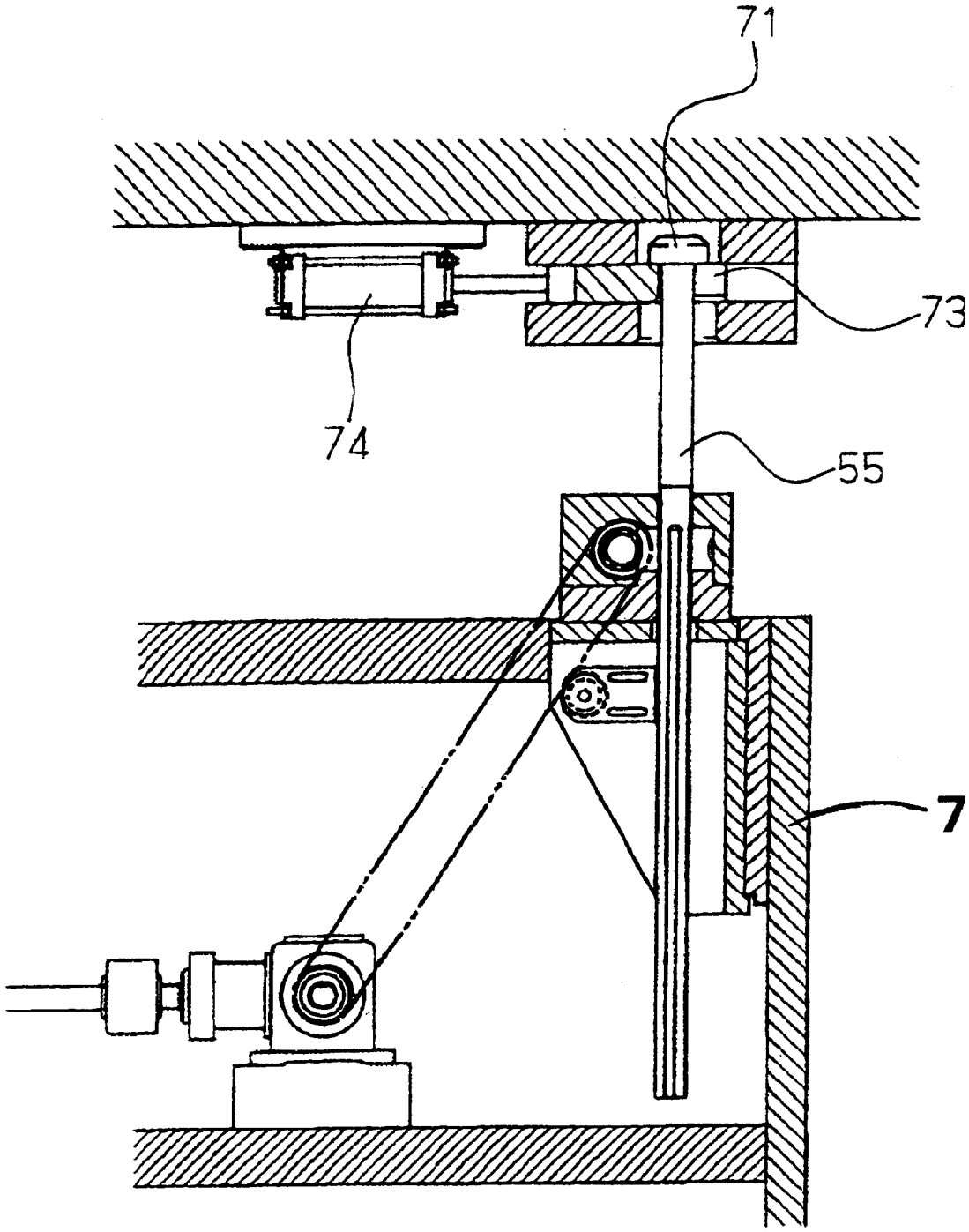
FIG. 6 is a detailed drawing of the main elements of the present invention.

Referring to FIGS. 5A, 5B and 6, slide 7 is positioned at a top-dead-center position and adjustments made so that the lower surface of projection 71 is above the upper surface of plate 73.

To lock slide 7, a locked position is defined when, using cylinder 74, plate 73 moves to a position where the upper surface of plate 73 abuts the lower surface of projection 71. A cut-out 73*a* of plate 73 is larger than the diameter of threaded member 55, i.e. the threaded member 55 is loosely fitted in cut-out 73*a*. Since cut-out 73*a* is smaller than projection 71, the lower surface of projection 71 will abut the upper surface of plate 73 if slide 7 accidentally drops.

In this embodiment, slide 7 is locked by moving plate 73 to a locked position, i.e., a position where the lower surface of projectional, abuts the upper surface of plate 73. As a result, when performing maintenance, inspection, or the like on the dies, slide 7 is prevented from accidentally dropping while all or part of the body of the user is in a danger zone. Where the top-dead-center position of slide 7 has been changed through die height adjustment, threaded member 55 is moved vertically in tandem with the change in die height H. Thus, the slide locking operation can be performed.

Referring back to FIGS. 1 through 4, when die height H is adjusted, threaded member 55 must be adjusted vertically so that the position of projection 71 will be the locked position as described above.

To adjust threaded member 55 vertically, the drive force of motor 13 is output to output shaft 10*a* via shaft 11 and gear box 10, and is transferred to slide adjusting mechanism 30. As the drive force of motor 13 is transferred, output shaft 10*a* rotates and sprocket 57 rotates. This rotation causes sprocket 56, worm screw 53, and worm wheel 54 to rotate via chain 58. Threaded member 55 is prevented from being rotated by a key, not shown. Threaded section 55*a* meshes with the inner perimeter of worm gear 54. Thus, the rotation of worm wheel 54 causes threaded member 55 to be adjusted vertically.

As a result, if the top-dead-center of slide 7 changes due to an adjustment in die height H, threaded member 55 is raised or lowered in sync with the adjustment, i.e., the fine adjustment of the vertical position of slide 7. Thus, slide 7 can be locked regardless of adjustments to die height H.

According to this embodiment, the mechanism for raising and lowering threaded member 55 is mechanically linked to slide adjusting mechanism 30 so that the two are moved in tandem through a simple structure. In addition to the advantages described above, this mechanism provides slide 7 locking that is easy and inexpensive to produce and install.

Figure 7:
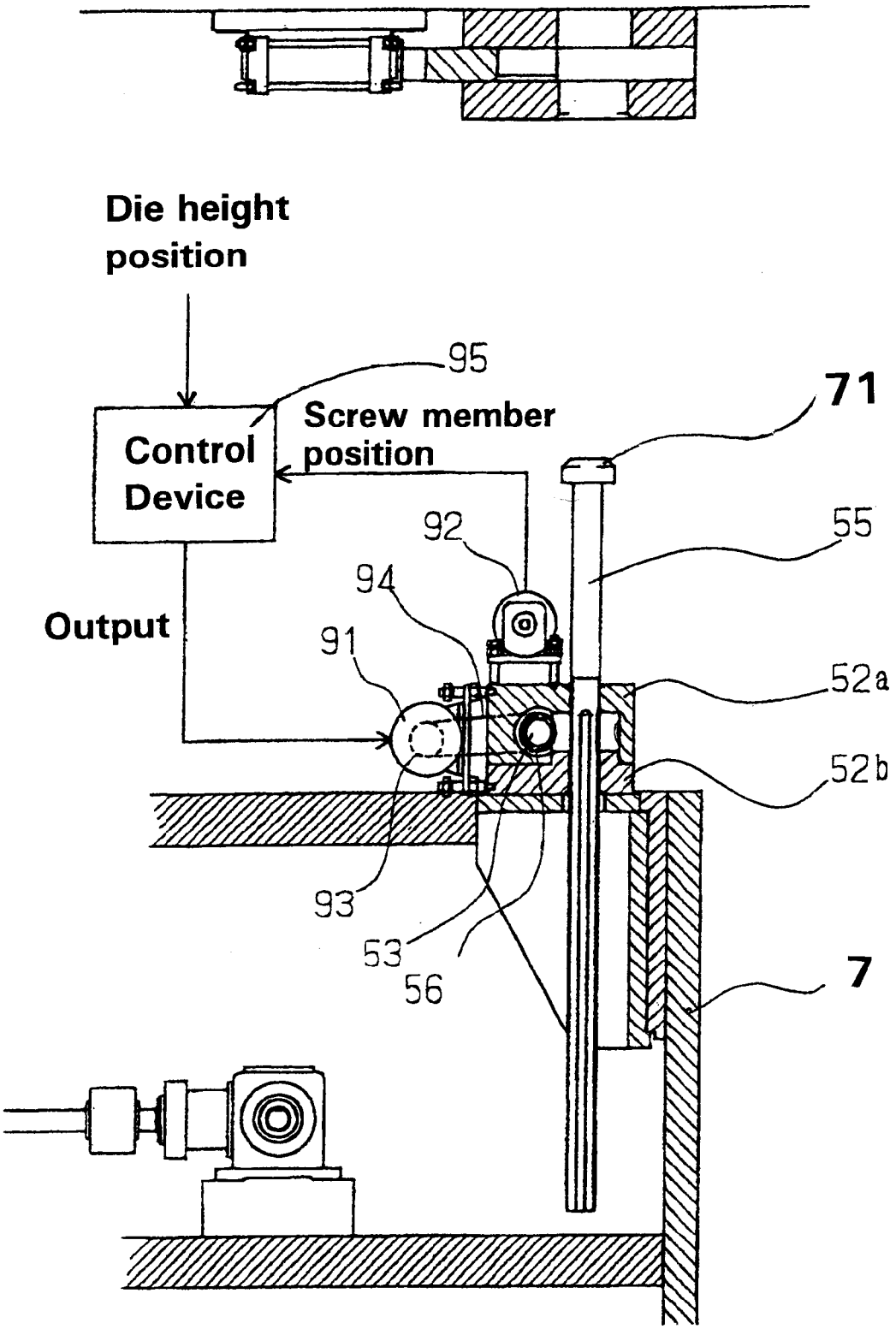
FIG. 7 is a detailed drawing of the main elements of the another embodiment of the present invention.

Additionally referring now to FIG. 7, the drive force for vertically adjusting threaded member 55 is provided by a dedicated motor 91. An encoder 92 detects the vertical position of threaded member 55 electronically. A second encoder (not shown), disposed in slide 7, and measuring die height H. The second encoder (not shown) detects the number of rotations made by shaft 11 and control device 95 converts this value to die height H.

Motor 91 for vertically adjusting threaded member 55 is disposed on the side surfaces of blocks 52*a,* 52*b.* A sprocket 93 is disposed on the drive shaft of motor 91. A chain 94 is extended across sprocket 93 and sprocket 56 fixed to worm shaft 53.

Encoder 92 is disposed on the upper surface of block 52*a*. The shaft of encoder 92 connects to worm shaft 53 via a flexible shaft (not shown in the figure).

Encoder 92 reads the number of rotations made by worm shaft 53. The number of rotations is converted into a vertical position value for threaded member 55 by control device 95. The die height value, measured by means for measuring die height, is also sent to control device 95. Control device 95 compares the vertical position of threaded member 55 and the die height and sends signals to activate motor 91 so that projection 71 is at the locked position when slide 7 is at the top-dead-center position. Thus, slide 7 can be locked even if the top-dead-center position of slide, 7 has been changed through die height adjustments.

Threaded member 55 can be independently adjusted regardless of die height adjustments by activating motor 91 without going through control device 95. Thus, projection 71 can be moved to the locked position regardless of the position of slide 7.

Thus this embodiment allows threaded member 55 to be raised or lowered in sync with die height adjustments and conveniently allows slide 7 to be locked in any slide position. Additionally, a drive source is provided for the raising and lowering of threaded member 55 and a drive source is provided for slide 7 adjusting mechanism. This allows the slide to be locked reliably and safely using a device with a simple structure and that can be produced inexpensively.

In the embodiments described above, as long as the drive force can be converted to vertical motion of threaded member 55, any type gear or wheel may be used. For example, bevel gears can be substituted for worm shaft 53 and worm wheels 54. Additionally, belts and pulleys may be substituted for the chains and sprockets. In other words, any mechanism or device that can transfer drive force may be used.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

Although only a single or few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures. Thus although a nail and screw may not be structural equivalents in that a nail relies entirely on friction between a wooden part and a cylindrical surface whereas a screw's helical surface positively engages the wooden part, in the environment of fastening wooden parts, a nail and a screw may be equivalent structures.

What is claimed is:

1. A slide locking mechanism for locking a slide comprising:

a threaded member projecting from said slide;

means for raising and lowering said threaded member in tandem with a die height adjustment;

means for locking said threaded member at a locked position;

said means for locking including a plate with a cut-out section;

said threaded member being loosely fitted through said cut-out section;

means for moving said plate to a locked position;

a projection at an upper end of said threaded member; and a lower surface of said projection abutting an upper surface of said plate at said locked position to prevent accidental motion of said slide.

2. A slide locking mechanism according to claim 1 wherein said means for raising and lowering said threaded member comprises:

means for preventing said threaded member from rotating;

a worm wheel including a threaded section in an inner perimeter section thereof;

said threaded section meshing with a threaded section of said threaded member;

a worm shaft meshing with an outer perimeter of said worm wheel; and means for transferring drive force connected to a slide adjusting mechanism for adjusting die height and transferring drive force from said slide adjusting mechanism to said worm shaft.

3. A slide locking mechanism according to claim 1 wherein said means for raising and lowering said threaded member comprises:

means for preventing said threaded member from rotating;

a worm wheel including a threaded section in an inner perimeter section thereof;

said threaded section meshing with a threaded section of said threaded member;

a worm shaft meshing with an outer perimeter of said worm wheel;

a motor driving said worm shaft;

means for electronically measuring die height;

means for electronically detecting a position of said threaded member and measuring a position of said threaded member; and a control device for raising and lowering said threaded member based on a value measured by said die height measuring means.

4. A slide locking mechanism for a slide comprising:

a member projecting from said slide;

means for raising and lowering said member with respect to said slide, said member being adjusted independent of a die height adjustment;

means for locking said member at a locked position with respect to said slide; and said means for locking said member including means for physically blocking motion of said member, whereby motion of said slide is prevented.

5. A slide locking mechanism for a slide comprising:

a member projecting from said slide;

means for raising and lowering said member with respect to said slide;

means for locking said member at a locked position with respect to said slide;

said means for locking said member including means for physically blocking motion of said member, whereby motion of said slide is prevented; and said means for blocking said member comprises:

a plate with a cut-out section through which said member is fitted;

means for moving said plate to a locked position;

a projection at an upper end of said member; and a lower surface of said projection abutting an upper surface of said plate at a locked position.

6. A slide locking mechanism for a slide comprising:

a member projecting from said slide;

means for raising and lowering said member with respect to said slide;

means for locking said member at a locked position with respect to said slide;

said means for locking said member including means for physically blocking motion of said member, whereby motion of said slide is prevented; and said means for raising and lowering said member comprises:

means for preventing said member from rotating;

a worm wheel including a threaded section in an inner perimeter section thereof;

said threaded section meshing with a threaded section of said member;

a worm shaft meshing with an outer perimeter of said worm wheel; and means for transferring drive force connected to a slide adjusting mechanism for adjusting die height from said slide adjusting mechanism to said worm shaft.

7. A slide locking mechanism for a slide comprising:

a member projecting from said slide;

means for raising and lowering said member with respect to said slide;

means for locking said member at a locked position with respect to said slide;

said means for locking said member including means for physically blocking motion of said member, whereby motion of said slide is prevented; and said means for raising and lowering said member comprises:

means for preventing said member from rotating;

a worm wheel including a threaded section in an inner perimeter section thereof;

said threaded section meshing with a threaded section of said member;

a worm shaft meshing with an outer perimeter of said worm wheel;

a motor driving said worm shaft;

means for electronically measuring die height;

means for electronically detecting a position of said member; and a control device for raising and lowering said member based on a value measured by said means for electronically measuring die height.

8. A slide locking mechanism as in claim 5, wherein said means for moving said plate to a locked position comprises a piston driving a rod attached to said plate.

9. A slide locking mechanism as in claim 7, wherein said means for transferring drive force connected to a slide adjusting mechanism comprises:

a first sprocket attaching to an output shaft connected to a motor;

a chain connecting said first sprocket to a second sprocket; and said second sprocket attaching to said worm shaft.

10. A slide locking mechanism as in claim 7, wherein said means for electronically measuring die height is an encoder.

11. A side locking mechanism as in claim 7, wherein said means for electronically detecting a position of said member is an encoder connected to said worm shaft.

* * * * *

UNITED STATES PATENT AND TRADEMARK OFFICE

CERTIFICATE OF CORRECTION

PATENT NO. : 6,530,313 B1
DATED : March 11, 2003
INVENTOR(S) : Masayoshi Sugawara et al.

It is certified that error appears in the above-identified patent and that said Letters Patent is hereby corrected as shown below:

Title page,
Item [73], Assignee, delete "Aida Engeneering Co., Ltd" and substitute with -- Aida Engineering Co., Ltd. --

Signed and Sealed this

Nineteenth Day of August, 2003

JAMES E. ROGAN
*Director of the United States Patent and Trademark Office*